US005438941A

United States Patent [19]

Henz et al.

[11] Patent Number: 5,438,941

[45] Date of Patent: Aug. 8, 1995

[54] TENTER FRAME, GUIDE AND DRIVE FOR EMBROIDERY MACHINES

[75] Inventors: Jürg Henz, Amriswil; Hans Abegglen; Xueliang Yu, both of Arbon, all of Switzerland

[73] Assignee: Saurer Sticksysteme AG, Switzerland

[21] Appl. No.: 246,512

[22] Filed: May 20, 1994

[30] Foreign Application Priority Data

May 20, 1993 [DE] Germany ..... 43 16 915.5

[51] Int. Cl.[6] ..... D05C 9/12

[52] U.S. Cl. ..... 112/90

[58] Field of Search ..... 112/78, 83, 84, 86, 112/90, 91, 80.31

[56] References Cited

U.S. PATENT DOCUMENTS

| | | | |
|---|---|---|---|
| 1,204,434 | 11/1916 | Hardegger | 112/90 |
| 2,649,065 | 8/1953 | Casper | 112/84 |
| 2,760,454 | 8/1956 | Lambach | 112/90 |
| 3,991,691 | 11/1976 | Bolldorf | 112/90 X |
| 4,603,646 | 8/1986 | Jenni | 112/90 |
| 4,765,266 | 8/1988 | Schuepp | 112/90 |

FOREIGN PATENT DOCUMENTS

| | | |
|---|---|---|
| 64215 | 4/1914 | Austria . |
| 2155192 | 5/1973 | Germany . |
| 652769 | 11/1985 | Switzerland . |

*Primary Examiner*—Clifford D. Crowder
*Assistant Examiner*—Ismael Izaguirre
*Attorney, Agent, or Firm*—Baker, Maxham, Jester & Meador

[57] ABSTRACT

An embroidery machine having horizontally parallel fabric shafts for the vertically arranged embroidery fabric. A plurality of upper and lower horizontal guides are distributed over the length of the machine. One upper and one lower horizontal guide are each connected to a horizontal guide element by vertical connection elements, the horizontal guide elements and the fabric shafts each being vertically adjustable by a positioning drive in guides mounted on the machine.

11 Claims, 2 Drawing Sheets

TENTER FRAME, GUIDE AND DRIVE FOR EMBROIDERY MACHINES

BACKGROUND OF THE INVENTION

1. Field of the Invention

This invention relates generally to embroidery machines and more particularly to improved structures for such machines which reduce the mass to be moved to maintain proper tension on the fabric and to provide the necessary movement and adjustability.

2. Discussion of the Related Art

The design and construction of the tenter frames by all the major manufacturers of industrial embroidery machines have long been essentially the same.

The tenter frame is arranged vertically and is positioned vertically/horizontally by increments in order to produce the embroidery design stitch by stitch. The embroidery stations with the embroidery tools (needles, shuttles, punches, among others) are arranged in horizontal rows with a constant repeat. Such a tenter frame is formed by an upper longitudinal beam ranging between 5 and 22 m long, with two vertical side frames that are attached at the sides and are connected again at the bottom by a simple longitudinal beam. Two pairs of parallel fabric shafts running over the entire length of the tenter frame are provided in the two side flames. The fabric to be embroidered is wrapped around these fabric shafts and stretched between two of such fabric shafts. Several vertical tenter frame supports which in turn support the long fabric shafts by means of special elements (shaft spoons or bailers) are provided between the upper and lower longitudinal beams.

In order to be able to position these tenter frames, which are up to 22 meters long and 3 meters high and can weigh more than 1000 kg, together with the fabric arranged on them, the upper longitudinal beam was moved vertically at two or more positions and one or both of the side frames were driven horizontally. Examples of such structures are disclosed in Swiss patent 652,769 and German patent 2,155,192.

In order to achieve higher speeds, this form of the tenter frame would have to be designed to be much more rigid, thereby increasing the mass to be moved. Only a fundamentally different design can solve this problem. Austrian patent 64,215 discloses one such attempt at such a solution. Instead of the upper longitudinal beam, there are several horizontally guided and driven longitudinal beams on which the vertically driven tenter frame supports are guided. However, this design has various disadvantages and in fact it has apparently never been implemented industrially.

SUMMARY OF THE INVENTION

A primary purpose of this invention is to reduce the moving mass by a novel design to such an extent that much higher speeds are possible without any sacrifice in positioning accuracy. The essential idea on which this invention is based thus consists of arranging or positioning all the drives, if possible, at the location where the respective part must be moved and thus eliminating as many frame parts and transmission elements as possible that would otherwise have to be moved as part of the total mass.

For the vertical movement, it would be advantageous to be able to move the elements that support the shaft (shaft spoons) directly. The supporting elements must be kept at a constant distance because a great tensile stress must be applied between the upper and lower fabric shafts in order to apply the proper tension to the fabric. When the elements supporting the fabric shafts are mounted directly on horizontal beams and the corresponding upper and lower horizontal guides are joined together rigidly, a horizontal guide element can in turn move directly in the vertical direction by means of a drive. Several such parallel horizontal guide elements that are moved vertically in synchronization can support pairs of fabric shafts of any desired length and can position them vertically without requiring a tenter frame.

This solution also makes it possible to mount the ends of the fabric shafts in a beam that runs in the horizontal guides. With such beams shifted horizontally in the horizontal guides by appropriate drives, the horizontal movement is applied directly to the fabric shafts.

The drives for turning the fabric shafts or for winding up and stretching the fabric can be mounted directly on the beams running in the horizontal guides, and thus here again it is possible to eliminate the need for additional transmission elements.

This design makes full use of the possibilities of modem lightweight servo drives which can be used in a decentralized location and nevertheless can be synchronized accurately. The conventional upper and lower longitudinal beams as well as the vertical side frames are eliminated. Instead of a heavy, rigid tenter frame, the tenter frame supports and the fabric shafts are moved directly, so the entire mass to be moved is reduced to a fraction of the mass conventionally used in the past. Together with the vertical, highly dynamic servo drives, it is thus possible to position large areas of tautly stretched fabric at a much faster rate.

BRIEF DESCRIPTION OF THE DRAWINGS

The objects, advantages an features of this invention will be more clearly understood from the following derailed description, when read in conjunction with the accompanying drawing, wherein.

BRIEF DESCRIPTION OF THE PREFERRED EMBODIMENTS

Figure 1:
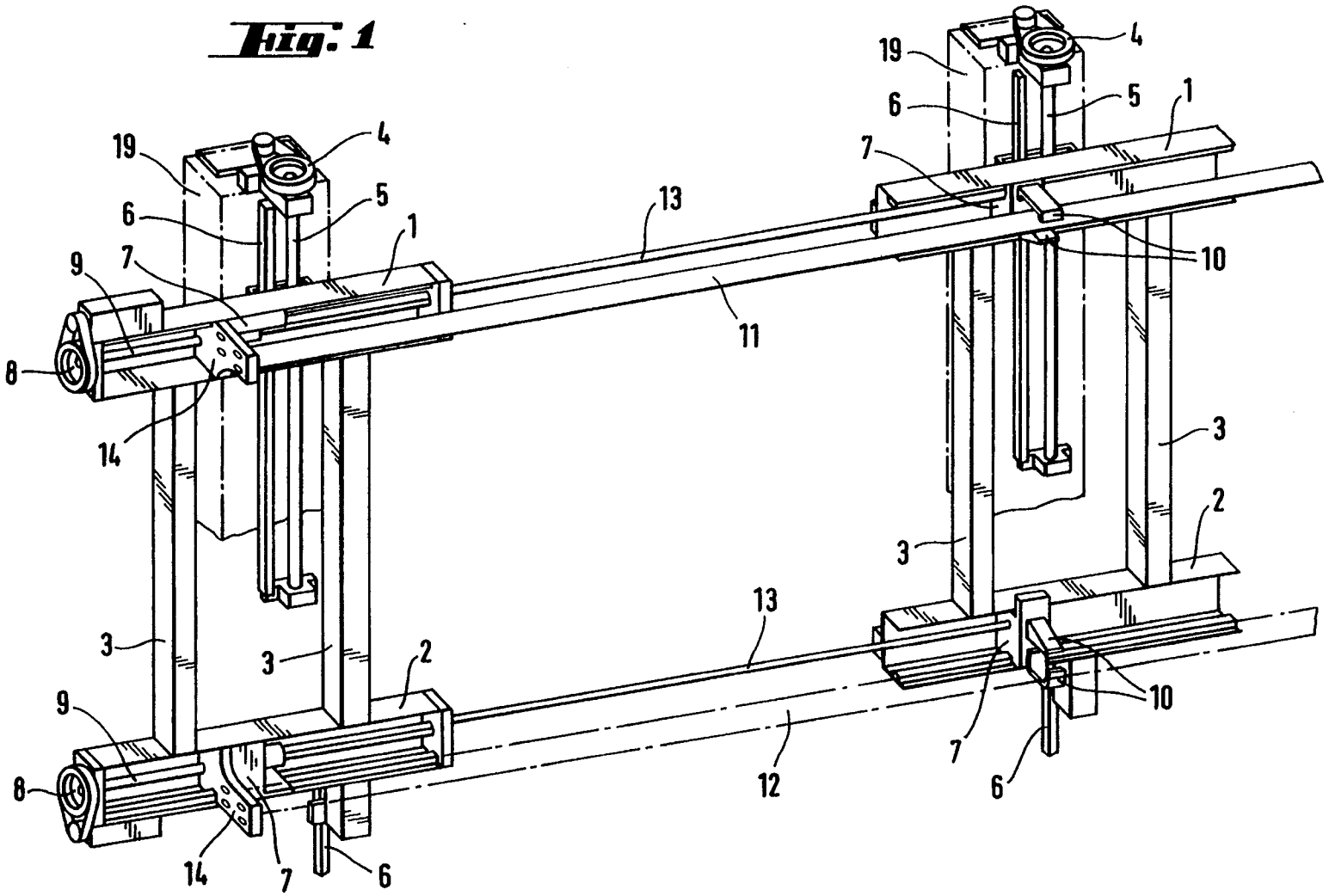
FIG. 1 is a perspective diagram of two horizontal guide elements with horizontal connecting elements and fabric shafts.
Figure 2:
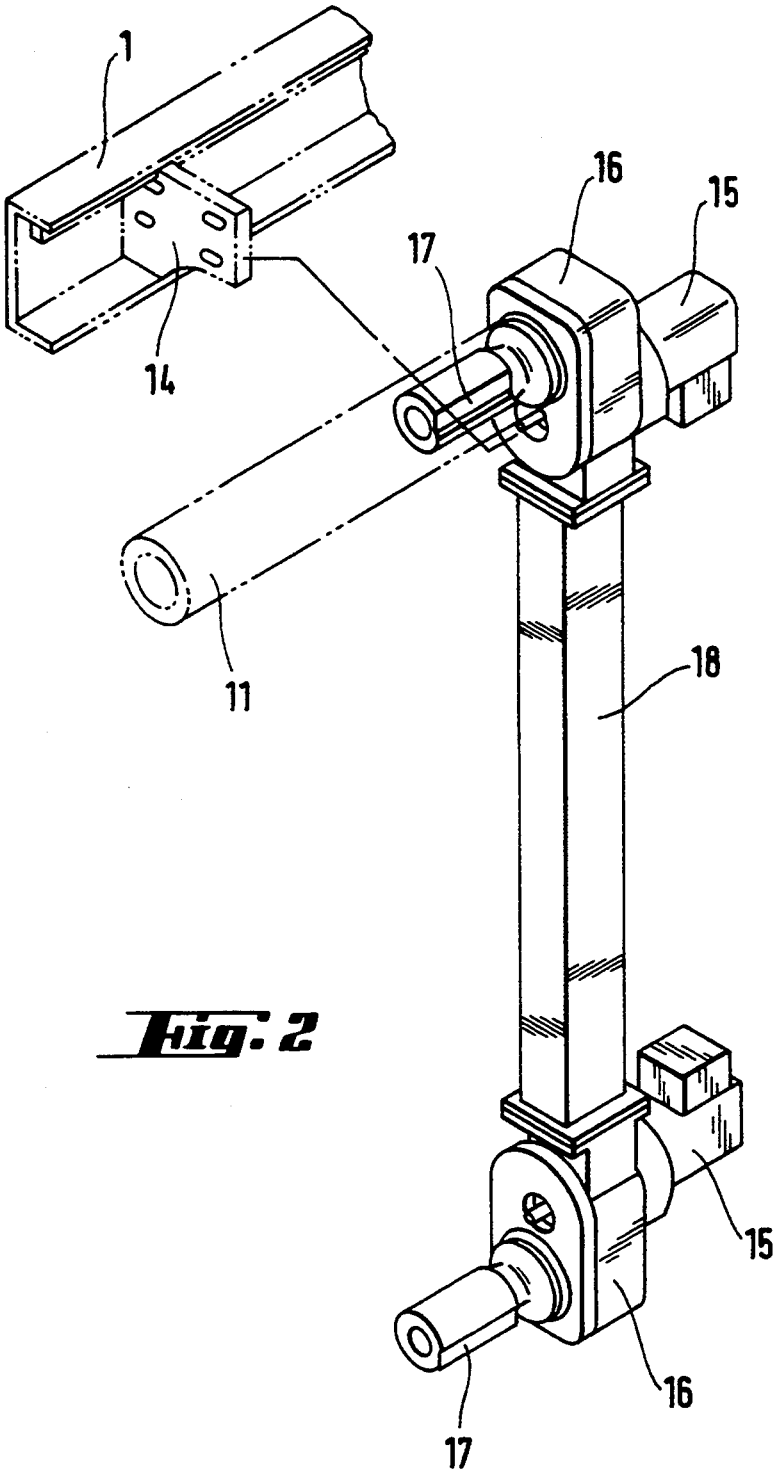
FIG. 2 is a perspective diagram of the upper and lower fabric shaft mounts with the drives and the vertical supports.

This invention is based on the idea of utilizing the possibilities of modem drive technology in the sense that the respective motors act directly on the elements that are to be driven. The technology of highly dynamic servo motors with electronic control and automation makes it possible to position these drives locally and in parallel. The drives for winding up and stretching the fabric are therefore mounted directly on the fabric shafts. The drives for horizontal positioning directly move the mounts for the fabric shafts or their beams. The horizontal guides of these beams are in turn positioned vertically directly by the respective drives.

With reference now to the drawing, upper horizontal guides 1 and lower horizontal guides 2 are arranged in parallel and in alignment in machine frame 19. A horizontally movable beam 7, which supports fabric shaft mounts 10 or flange 14 for fabric shaft mount 17, is provided in each horizontal guide 1, 2. Since tensile forces occur between fabric shaft mounts 17 or 10 due to the stretching of the fabric, fixed connection elements 3 which keep horizontal guides 1, 2 and thus fabric shafts 11, 12 at a predetermined distance are provided between the upper and lower horizontal guides.

Due to the connection of upper horizontal guide 1 and lower horizontal guide 2 by means of fixed connection element 3, this yields a rigid horizontal guide element that is positioned vertically as a whole. For this purpose, rigid vertical guides 6 and vertical spindles 5 are mounted on machine frame 19. Positioning drive 4 drives spindles 5 directly. On short embroidery machines, two such horizontal guide elements are enough to support upper and lower fabric shafts 11, 12, stretch the fabric between them and position the stretched fabric vertically. On longer machines, several of these horizontal guide elements may be arranged in parallel and positioned vertically in synchronization by means of their drives.

Fabric shaft mounts 10 are held in beams 7 in horizontal guides 1, 2 and they in turn hold fabric shafts 11, 12 so they can rotate. Flanges 14 are mounted on beams 7 in one or both of the horizontal guide elements at the ends of the machine. The left end is shown in the drawing as an example. Flanges 14 hold fabric shaft mounts 17. These fabric shaft mounts are driven by means of fabric shaft motors 15 and fabric shaft gear 16 in such a way that the fabric is unwound from the fabric shafts or wound up onto them or the fabric is put under tension by the rotation of the fabric shafts in opposite directions. The resulting tensile forces are absorbed by supports 18. Rotation of the fabric shafts in the same direction causes the fabric to be wound from the bottom shaft to the top shaft or vice versa.

If the two fabric shafts are rotated in opposite directions, the torque can be measured by means of known devices and thus the fabric tension can be determined directly. This fabric tension can be displayed continuously in the process or it can be input as a setpoint in the drive controller and thus achieved automatically. Since the measurement and control apparatus are conventional they are not shown.

By analogy with the vertical drives, spindles 9 are provided in horizontal guides 1, 2 at the ends of one or both of the horizontal guide elements.

Beams 7 are shifted horizontally with positioning drives 8 by means of spindles 9. In this way, the horizontal positioning movement is transmitted over flanges 14 and fabric shaft mounts 17 to fabric shafts 11, 12. Synchronization of upper and lower drives 8 is possible with electronic control and automation systems which are conventional and are now shown.

Due to the tension applied to the fabric, fabric shafts 11, 12 are pressed against fabric shaft mounts 10. The resulting frictional contact shifts the respective mounts 10 and thus beams 7 in synchronization when there is a horizontal movement of the fabric shafts. If this frictional contact is not enough to move the mounts when the fabric tension is low, then each horizontal guide could be equipped with positioning drive 8. However, a horizontal connection of all beams 7 or mounts 10 and mounts 17 by means of lightweight horizontal connecting elements 13 is less expensive, so a synchronous movement of all the elements that support fabric shafts is assured.

In another embodiment, the height of the embroidery or stitching, that is, the distance between the upper and lower horizontal guides, can be adjustable. For this purpose, the length of fixed connection elements 3 and vertical supports 18 must be adjustable or designed so the length can be fixed at certain settings. This can be accomplished manually or with the help of motor-driven adjustments and fixtures. In this way, fabric shafts 11, 12 or the elements that replace them can be fixed at certain intervals. This design is advantageous especially when the fabric to be embroidered runs "continuously," so to speak through the machine in horizontal increments. The fabric shafts are then replaced by horizontal tension and guide elements. Due to this method of the adjustable "stitch height" the embroidery machine can easily be adapted to different widths of fabric. Vertical stretching of a fabric can also be achieved with the same devices.

In view of the above description it is likely that modifications and improvements will occur to those skilled in the applicable technical field which are within the scope of the appended claims.

What is claimed is:

1. An embroidery machine to embroider a fabric mounted in a vertical plane, said machine having fabric shafts for mounting said embroidery fabric, said fabric shafts being arranged in parallel horizontally with respect to the ground, wherein said embroidery machine comprises:

a machine frame;

a plurality of upper and lower horizontal guides fixed to said machine frame and distributed along said embroidery machine;

elongated vertical connection elements connecting one of said upper horizontal guides to one of said lower horizontal guides respectively to form several horizontal guide elements;

several vertical positioning drives, one vertical positioning drive for each of said horizontal guide elements; and a plurality of vertical guides mounted stationarily on said machine frame, each of said horizontal guide elements being vertically adjustable in said vertical guides by one of said positioning drives, respectively.

2. The embroidery machine recited in claim 1, and further comprising means for synchronizing all of said vertical positioning drives with each other to thereby synchronize the movement of said horizontal guide elements.

3. The embroidery machine recited in claim 1, and further comprising:

a horizontally movable beam in said upper horizontal guides and said lower horizontal guides; and fabric shaft mounts for coupling said fabric shafts to each said horizontally movable beam.

4. The embroidery machine recited in claim 1, and further comprising horizontal positioning drives coupled to said upper and lower horizontal guides for shifting said horizontally movable beams together with said fabric shafts the fabric which is stretched over said fabric shafts.

5. The embroidery machine recited in claim 4, wherein said horizontal positioning drives are synchronized with each other in said upper and lower horizontal guides for synchronized movement of said horizontally movable beams.

6. The embroidery machine recited in claim 3, wherein horizontal movement of said fabric shafts resulting from connection between the fabric on said fabric shafts and said fabric shaft mounts cause said fabric shaft mounts and said horizontally movable beams coupled to said fabric shaft mounts to be entrained along said upper and lower horizontal guides.

7. The embroidery machine recited in claim 3, and further comprising horizontal connecting elements horizontally connecting said upper and lower movable beams or said fabric shaft mounts so that said fabric shaft mounts also follow the horizontal movements.

8. The embroidery machine recited in claim 3, and further comprising fabric shaft drive means connected to said fabric shaft mounts, said fabric shaft drive means being provided in the respective said horizontal guides on said upper and lower movable beams on at least one end of said machine, thereby permitting said fabric shafts to be rotated for selectively winding up, unwinding and applying tension to the fabric.

9. The embroidery machine recited in claim 8, wherein said fabric shaft drive means are adapted to maintain a predetermined fabric tension.

10. The embroidery machine recited in claim 3, and further comprising elongated vertical support means rigidly connected to said fabric shaft mounts or to said horizontally movable beams to apply tension to the fabric.

11. The embroidery machine recited in claim 10, wherein said vertical connection elements between said upper and lower horizontal guides and said vertical support means between said upper and lower fabric shaft mounts are both adjustable in length to provide any desired distance between said upper and lower fabric shafts, and to permit tension to be applied to the embroidery fabric.

* * * * *